United States Patent [19]

Arnone

[11] 4,159,871

[45] Jul. 3, 1979

[54] PHOTOGRAPHIC RETOUCHING APPARATUS

[76] Inventor: Joseph A. Arnone, 258 Briggs St., Syracuse, N.Y. 13208

[21] Appl. No.: 932,130

[22] Filed: Aug. 9, 1978

[51] Int. Cl.[2] ..... G03D 15/00

[52] U.S. Cl. ..... 354/350; 248/456; 362/33; 108/10

[58] Field of Search ..... 354/348, 349, 350; 362/3, 8, 33, 127, 97; 248/455, 456; 108/9, 10

[56] References Cited

U.S. PATENT DOCUMENTS

| | | | |
|---|---|---|---|
| 144,723 | 11/1873 | Wright | 354/350 |
| 456,555 | 7/1891 | Cutler | 354/349 |
| 1,231,740 | 7/1917 | Horak | 354/350 |
| 2,328,471 | 8/1943 | Leffel | 362/97 |
| 2,422,174 | 6/1947 | Adams | 354/350 |
| 2,498,168 | 2/1950 | Lloyd | 354/350 |
| 2,583,097 | 1/1952 | Heimann | 248/456 |
| 2,585,423 | 2/1952 | Ball | 354/350 |
| 2,740,345 | 4/1956 | Johnson | 354/350 |
| 2,930,307 | 3/1960 | Skomsvold | 354/350 |
| 3,239,297 | 3/1966 | Bosko et al. | 108/9 |

*Primary Examiner*—L. T. Hix
*Assistant Examiner*—Alan Mathews
*Attorney, Agent, or Firm*—Bruns & Jenney

[57] ABSTRACT

Apparatus for use in retouching both positive and negative photographic prints of various sizes. The apparatus includes a flat base member that is capable of being seated upon a desk or the like and a working board pivotally mounted upon the base at one end thereof by means of an adjustable slide mechanism whereby both the vertical and horizontal relationship of the board in reference to the base may be conveniently adjusted. An illuminated vibratory disc is recessed into the working surface of the board with the top surface of the disc being flush with the working surface of the board thereby allowing a photographic print having a larger surface area than that of the disc to be processed thereon.

9 Claims, 6 Drawing Figures

PHOTOGRAPHIC RETOUCHING APPARATUS

BACKGROUND OF THE INVENTION

This invention relates to apparatus for retouching both negative and positive photographic prints and, in particular, to a vibratory photograph retouching board upon which prints of various sizes may be conveniently processed.

More specifically, this invention relates to a vibratory photograph retouching stand that is fully adjustable and which can be folded into a compact package for carrying and storing.

Until recently, most, if not all, photograph retouching work was performed upon relatively small negative prints simply because the retouching pencils and pens used in the art to perform work were not able to effectively lay down materials upon the glossy surfaces of positive prints. Lacquer sprays, such as those marketed under the name RETOUCH-O-MAT, are now available which, when applied to the surface of a positive print, make it possible to produce extremely high quality prints using conventional retouching tools and techniques. However, most photograph retouching stands, particularly those using vibrating surfaces as disclosed in U.S. Pat. No. 2,585,423, 2,498,168 and 2,422,174, have been specifically designed to handle relatively small size negatives and are, for the most part, wholely unsuitable for use in processing larger size positive prints. Furthermore, the prior art retouching tables are relatively rigid structures of fixed construction which cannot be adjusted or readily moved.

SUMMARY OF THE INVENTION

It is therefore an object of the present invention to improve photographic retouching stands.

A still further object of the present invention is to provide a vibratory photographic retouching device upon which both positive and negative prints of varying sizes and shapes may be conveniently processed.

Another object of the present invention is to provide photographic reproducing stand that may be conveniently folded into a compact package for carrying and storing.

Yet another object of the present invention is to provide a light-weight easel for retouching photographs which can be adjusted both vertically and horizontally at the user's option to a working position most convenient for the retouching of a photograph mounted thereupon.

These and other objects of the present invention are attained by means of a photographic retouching stand that includes a base member which is capable of being seated upon a relatively flat support surface such as a desk or the like, an easel or work board having a flat working surface, a slide mechanism for securing the work board to the base member whereby the board can be adjusted both vertically and horizontally in reference to the base member, a vibratory disc centrally mounted within the work board with the top surface of the disc being supported in coplanar alignment with the working surface of the board whereby photographic prints having a surface area greater than the surface area of the disc can be supported in a flat condition upon the surface of the board, and vibrating means operatively associated with the disc to vibrate the disc at a predetermined amplitude and frequency.

BRIEF DESCRIPTION OF THE DRAWINGS

For a better understanding of these and other objects of the present invention reference is had to the following detailed description of the invention to be read in conjunction with the accompanying drawing, wherein.

DESCRIPTION OF THE INVENTION

Figure 1:
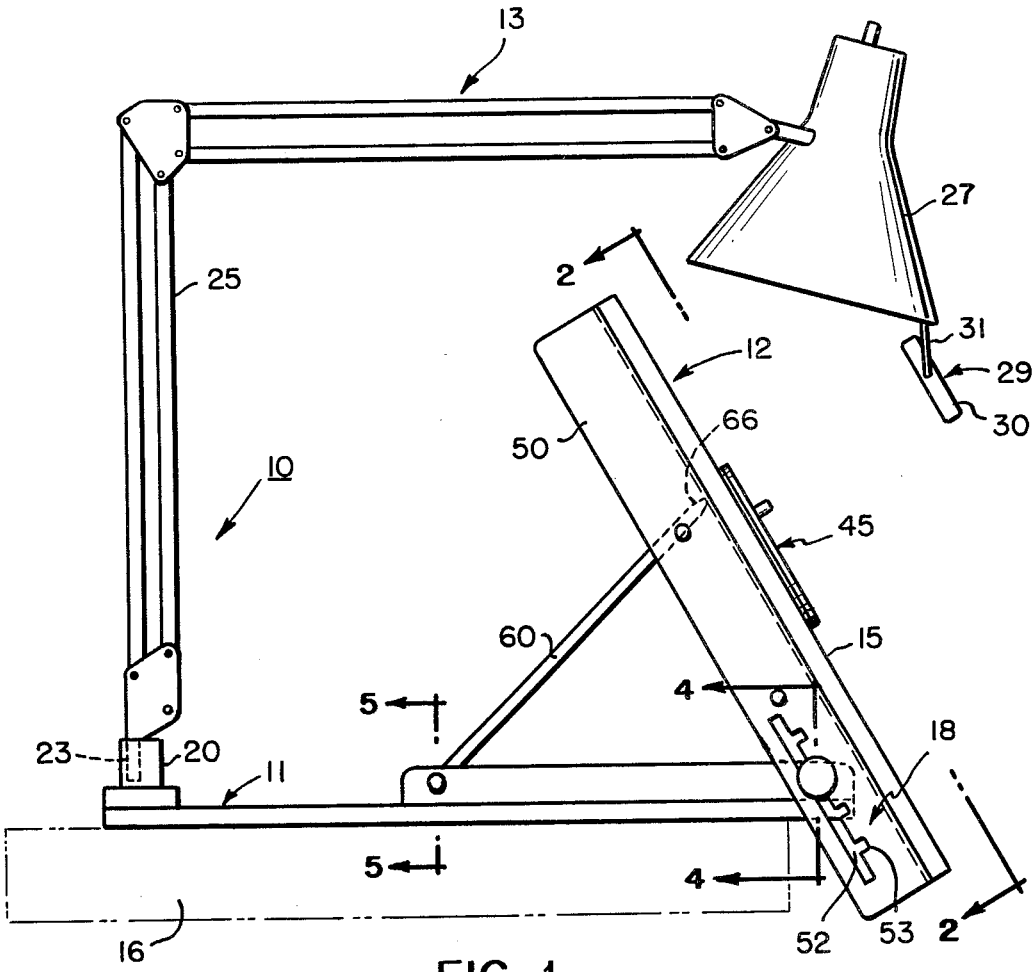
FIG. 1 is a side elevation of the retouching apparatus embodying the teachings of the present invention showing the apparatus being mounted upon a relatively flat horizontal support surface.

The retouching apparatus of the present invention, which is generally referenced 10, is illustrated in an operative condition in FIG. 1. In assembly, the device includes a planar base member 11, an easel or working board 12 and an adjustable lamp 13 used to illuminate the flat working surface 15 of the board. The assembly is designed to be seated upon the horizontal surface of a desk or table 16, as shown in phantom outline in FIG. 1. As will be explained in greater detail below, the retouching board 12 is pivotally supported at one end of the base member by means of a slide mechanism 18. When in use, the pivot point of the board is normally situated at the edge of the desk or table so that the board may be adjusted in both the vertical and horizontal directions to place the board at a desired working position.

A mounting flange 20 is centrally secured to the top surface 21 of the base at the rear margin thereof. The mounting flange is preferably constructed of a high strength plastic material and contains a vertical hole formed therein for slidably receiving a pivot pin 23 which is secured to the bottom of adjustable lamp frame 25. The distal end of the adjustable lamp supports a shade 27 which, in turn, contains a source of illumination (not shown) such as a conventional light bulb or the like. The adjustable frame is adapted to carry the shade over the top of the board and, in conjunction with the pivot pin arrangement, allows the source of illumination to be directed at any desired region on the surface of the board. A magnifying lens 29, mounted in a support 30, is suspended from the lower rim of the lamp shade by means of a bracket 31 to permit the lens to be selectively positioned and thus enable the user to view the illuminated region therethrough.

Figure 2:
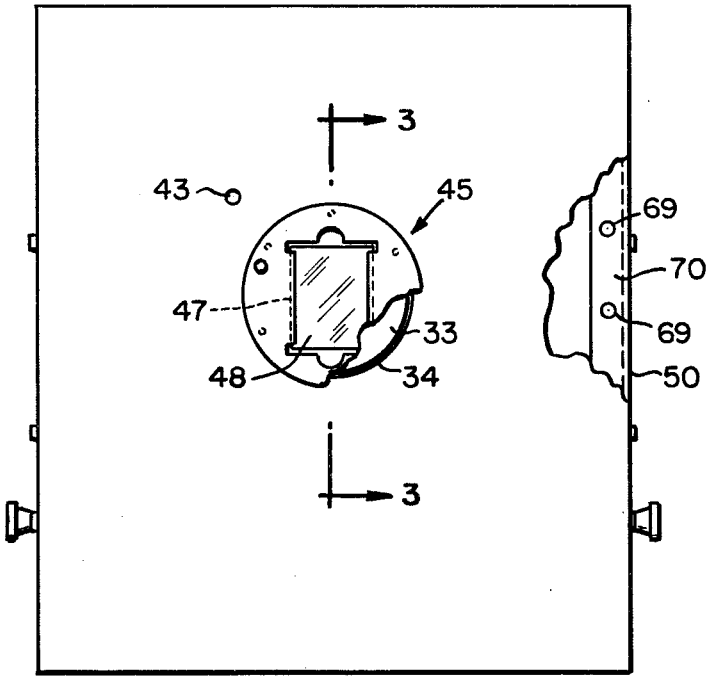
FIG. 2 is a view taken along lines 2—2 in FIG. 1 illustrating the working surface of the retouching apparatus of the present invention.
Figure 3:
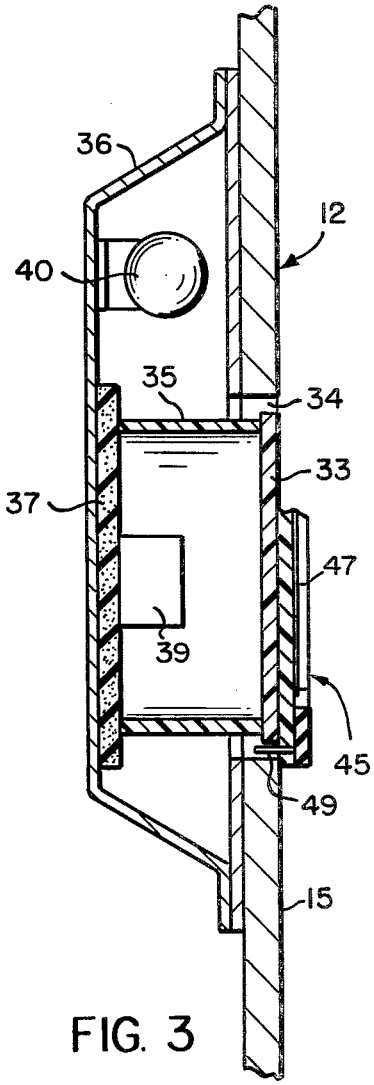
FIG. 3 is an enlarged view in section taken along lines 3—3 in FIG. 2 illustrating in further detail the vibratory disc utilized therein and a light source for illuminating the disc.

Referring more specifically to FIGS. 2 and 3, there is shown a vibratory disc 33 that is formed of a light-transmitting material and which is recessed within an opening 34 formed in the central region of the retouching board surface. The disc is mounted upon a clear plastic cylinder 35 which, in turn, if affixed to the bottom wall of a light shield 36 upon a resilient pad 37. The light shield is a substantially light tight structure that is secured by means of screws or the like to the back surface of the board to provide a relatively rigid fixture for supporting the disc assembly. The height of the clear plastic cylinder is such that the top surface of the disc is held in coplanar alignment with the top or working surface of the board whereby large photographs, which are typically positive prints, can be processed thereupon. The term large print, as herein used, refers to a photographic print having a surface area which is larger than the surface area of the vibrating disc.

A vibrator 39, of any suitable construction, is located within the cylinder and is operatively attached thereto to vibrate the cylinder, and thus the disc mounted thereupon, at a predetermined frequency and amplitude. The cylinder is adapted to act against the resilient pad so as to dampen the system and to suppress any disturbing noises that might be generated in the system.

Mounted adjacent to the cylinder, beneath the light shield, is a fixed light source 40. Light energy from this source is predominantly contained within the shield and is directed upwardly through the cylinder to illuminate the vibratory disc. Reflecting surfaces may be strategically positioned about the inside of the shield and along the back of the cylinder to direct the captured light towards the disc. Although not shown, suitable electrical leads and controls are also provided to power and regulate the electrical components. These can include means to vary the intensity of the light source and to also adjust the frequency of vibrations delivered by the vibrator. A small window 43 (FIG. 2), which is flush with the surface of the easel, is furnished to provide a color coded visual signal when the lamp is lighted.

As best seen in FIG. 2, a holding fixture, generally referenced 45, for supporting negative prints is removably positioned over the top of the vibratory disc 33. The fixture contains a recessed frame 47 into which a standard size negative (not shown) may be easily inserted for processing. When the negative is loaded into the frame, it is automatically centered in clear window 48 and seated in contact against the top surface of the disc. The holding fixture also includes a series of pin-like fasteners 49 equally spaced about the outer periphery thereof which extend downwardly into the opening 34 formed within the board. The fasteners are arranged to frictionally engage the vertical side wall of the disc in light sliding contact therewith so as to hold the fixture to the disc while, at the same time, allowing it to be easily removed when larger sized prints are to be processed. Normally, with a negative positioned within the frame, the light source 40 will be turned on to illuminate the disc behind the negative and thereby enabling the negative to be more easily processed. The vibrator, at this time, is also actuated and set to a desired vibrating level. The retoucher now simply has to bring his retouching tool against those areas of the negative containing blemishes or other imperfections and make the necessary corrections to produce a high quality picture.

In the event that a large size positive print is to be retouched, the negative holding fixture is removed from the board by lifting the fixture upwardly, normal to the surface of the board, until the fasteners clear the top of the disc. The large print, which has been treated with lacquer, is then placed on the working surface over the vibratory disc. At this time, lamp 40, which is used to illuminate the disc, is inactivated, and the adjustable lamp 13 is employed as explained above to illuminate the surface of the print. Because the top surface of the disc is in coplanar alignment with the top or working surface of the board, selected areas on the large size print to be retouched may be conveniently brought over the disc and processed in a conventional manner to produce a high quality defect-free picture.

Figure 4:
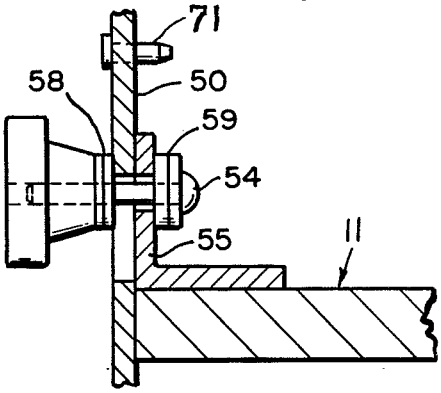
FIG. 4 is a partial enlarged section taken along lines 4—4 in FIG. 1 showing one of the hinge pins used in the present invention for securing the board at a desired working position.

A pair of opposed depending side walls 50—50 of similar construction are supported beneath the lower surface of board 12. In practice the side walls are metal angles that are secured to the board by any suitable means. A slide mechanism is formed in the front section in each wall and includes an elongated slot or hole 52 which passes through the wall and a series of spaced apart notches 53 that are formed in the top wall of the elongated slot. As illustrated in FIG. 4, a threaded hinge pin 54 is passed through raised side margins 55—55 supported upon the top of base member 11. In practice, the margins are channel members that are brought to the vertical side edge of the board as shown. When assembled, the side walls of the board pass downwardly over the margins in close proximity therewith.

The threaded shank of each hinge pin is adapted to extend outwardly through the slotted hole in the slide mechanism contained in the adjacent side wall of the board to pivotably support the board at the front end of the base. To change the vertical positioning of the board, the board is simply rotated about the hinge pins to any desired position. The elevation or horizontal positioning of the board is changed by repositioning the hinge pin in one of the plurality of notches formed along the top wall of the elongated slot. Once moved to a selected position, a thumb nut 56, which is threaded onto the shank of the hinge pin, is turned down to force the two adjacent members into locking contact with each other. Friction washers 58, 59 are also employed on either side of the hinge pin assembly to help secure the thumb nut in a locked condition.

Figure 5:
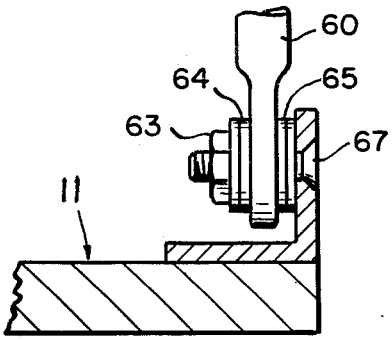
FIG. 5 is an enlarged section taken along lines 5—5 in FIG. 1 illustrating means for pivotally securing a support standard to the base member of the apparatus shown in FIG. 1.

A support standard 60 is pivotally supported at one end in one of the side margins 55 of the base member by means of a pivot pin 61 as best shown in FIG. 1. One end of the pin has a countersunk head which is seated in the portion of the side margin while the opposite end of the pin is threaded to receive thereon a nut 63 (FIG. 5). The nut acts in conjunction with a pair of friction washers 64, 65 to retain the standard upon the pin. The opposite end of the standard is necked down to form a blunt point 66 which is receivable in a series of spaced apart holes 69 formed in the underturned leg 70 of opposing side wall 50 (FIG. 2). The standard, when raised to a supporting position, serves to reinforce the holding force provided by the thumb nuts and thus secure the board in a desired location.

Figure 6:
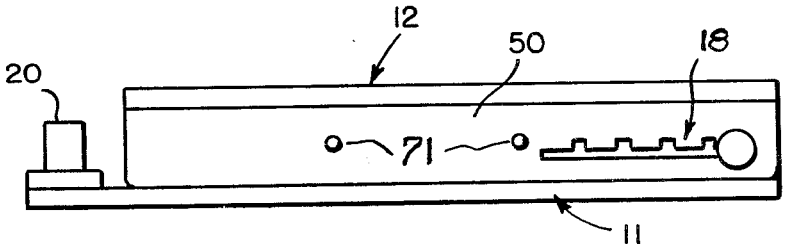
FIG. 6 is a side elevation of the apparatus shown in FIG. 1 illustrating the board folded back against the base member in a stored condition with the adjustable lamp removed therefrom.

When the board is to be stored or transported to a new or remote location, the lamp is removed from the base and the board is folded downwardly against the base as illustrated in FIG. 6 to provide a relatively compact package. To achieve a folded condition, the thumb nuts associated with the hinge pins are loosened and the standard stored in a fold-down position. The board is then rotated to a horizontal position and moved rearwardly on the base as far as the slide mechanism will allow. A pair of stop pins 71—71 are press fitted into each side wall of the board as seen in FIG. 4. The stop pins are adapted to come into arresting contact with the upper surfaces of base mounted side margins 55—55 and support the board thereupon in a horizontal condition. The board is locked in the closed or stored condition by simply retightening the thumb nuts. To prevent damage, the negative holding fixture 45 is also removed from the assembly and stored with the lamp in a safe place.

While this invention has been described with reference to the details as set forth above, it is not necessarily limited to the specific structure as disclosed and the invention is intended to cover any modifications or changes that may come within the scope of the following claims.

I claim:

1. Apparatus for retouching photographic prints including a planar base member that is capable of being seated upon relatively flat support surface, a work board having a flat working surface and two opposite side walls depending downwardly therefrom which are arranged to pass over the side margins of the base member, a slide formed in each of said opposite side walls of the base that includes an elongated slot passing through said side wall that is generally parallel to the working surface of the board and having a plurality of spaced-apart notches formed in the upper wall thereof, a pair of hinge pins supported in the side margins of the base member and being arranged so that one of said pins passes outwardly through each of the adjacently positioned slides whereby the board may be selectively located in said notches and simultaneously rotated about said hinge pins to adjust both its elevation and angular positioning, locking means associated with said hinge pins for securing said board in a selected position, a vibratory disc centrally mounted in said board with the top surface of said disc being co-planar with the working surface of the board whereby a photographic print having a surface area greater than the surface area of the disc can be supported in a flat condition upon the working surface of the board, said disc being supported in noncontiguous relation with said board, and vibrating means operatively associated with the vibratory disc for vibrating the disc at a predetermined frequency.

2. The apparatus of claim 1 which further includes a negative support plate containing a frame into which a photographic negative may be inserted and having a downwardly extending clasp means being adapted to pass over the disc in close sliding relationship therewith so that the plate is caused to move with the disc as the disc vibrates.

3. The apparatus of claim 2 wherein the disc is formed of a light-transmitting material and is mounted upon a transparent cylinder that passes downwardly through the board and further includes a fixed light source mounted beneath the board to direct light into the cylinder whereby the disc is illuminated.

4. The apparatus of claim 3 which further includes a light shield secured to the bottom surface of the board and which encompasses the light transparent cylinder and the fixed light source whereby a preponderance of the light emitted from said source is caused to pass through the disc.

5. The apparatus of claim 4 whereby the depth of the light shield is less than the depth of the side walls of the board whereby the board can be rotated about the hinge pins into overlying parallel alignment with said base member.

6. The apparatus of claim 1 which further includes a lamp pivotally mounted upon the base having an adjustable arm for supporting a working light over the working surface of the board.

7. The apparatus of claim 6 wherein the lamp includes a shade mounted over the working light that is arranged to direct illumination onto the working surface of the board, and said shade having a magnifying glass movably supported therein for viewing the illuminated region.

8. The apparatus of claim 6 having a support means mounted on the back of the base member for slidably receiving therein a pivot pin secured to the lamp whereby the lamp may be removed from said board.

9. The apparatus of claim 1 which further includes a support standard pivotally mounted at one end in said base member, the other end of said standard being receivably supported in a plurality of spaced-apart blind holes carried in said board.

* * * * *